US005839974A

United States Patent [19]

McAllister

[11] Patent Number: 5,839,974

[45] Date of Patent: Nov. 24, 1998

[54] GOLF PUTTER CONSTRUCTION

[76] Inventor: William F. McAllister, 8416 Westridge, Raytown, Mo. 64138

[21] Appl. No.: 883,612

[22] Filed: Jun. 26, 1997

[51] Int. Cl.[6] ..... A63B 53/08

[52] U.S. Cl. ..... 473/337; 473/340; 473/342; 273/DIG. 14

[58] Field of Search ..... 473/324, 334, 473/335, 336, 337, 338, 339, 340, 342, 349, 350; 273/DIG. 14

[56] References Cited

U.S. PATENT DOCUMENTS

| | | | |
|---|---|---|---|
| 1,133,129 | 3/1915 | Govan | 473/337 |
| 1,449,559 | 3/1923 | Relle | 473/342 |
| 1,485,685 | 3/1924 | McMahon | 473/342 |
| 1,494,494 | 5/1924 | Lippincott | 473/342 |
| 3,652,094 | 3/1972 | Glover | 473/337 |
| 3,847,399 | 11/1974 | Raymot . | |
| 3,873,094 | 3/1975 | Sebo et al. . | |
| 4,043,563 | 8/1977 | Churchward | 473/338 |
| 4,730,830 | 3/1988 | Tilley . | |
| 4,754,977 | 7/1988 | Sahm | 473/337 |
| 5,050,879 | 9/1991 | Sun et al. | 473/338 |
| 5,121,922 | 6/1992 | Harsh, Sr. . | |
| 5,230,509 | 7/1993 | Chavez . | |
| 5,253,869 | 10/1993 | Dingle et al. . | |
| 5,571,053 | 11/1996 | Lane . | |

*Primary Examiner*—Sebastiano Passaniti
*Attorney, Agent, or Firm*—Henderson & Sturm

[57] ABSTRACT

A golf putter construction 10 comprising a putter head member 20 having a putter head body 21 provided with a generally vertical face 22 having a plurality of apertures 24 formed therein and dimensioned to receive a like plurality of insert members 30 including weighted elements 32 which may be captively retained within the putter head member 20 by a clear impact cover plate 25.

1 Claim, 2 Drawing Sheets

GOLF PUTTER CONSTRUCTION

STATEMENT REGARDING FEDERALLY SPONSORED RESEARCH OR DEVELOPMENT

Not applicable.

CROSS REFERENCE TO RELATED APPLICATIONS

Not applicable.

REFERENCE TO MICROFICHE APPENDIX

Not applicable.

BACKGROUND OF THE INVENTION

1. Field of the Invention

The present invention relates to the field of golf putters in general, and in particular to a front loaded variably weighted golf putter construction.

2. Description of Related Art

As can be seen by reference to the following U.S. Pat. Nos. 5,121,922;, 5,230,509; 5,253,869; and 5,571,053, the prior art is replete with myriad and diverse variably weighted putter constructions.

While all of the aforementioned prior art constructions are more than adequate for the basic purpose and function for which they have been specifically designed, they are uniformly deficient with respect to their failure to provide a simple, efficient and practical front loaded variably weighted putter construction that will allow each golfer to customize and localize the weighting of a putter head to compensate for their own particular putting stroke tendencies.

As most golfers are all too painfully aware, a missed short puff counts as much on your scorecard as your best drive, and the majority of strokes that are taken on each hole occur on and in the vicinity of the putting green.

As a consequence of the foregoing situation, there has existed a longstanding need for a new and improved type of putter head construction that allows the face of the putter to be variably weighted to counteract the golfers tendency to open or close the putter face during the putting stroke and the provision of such a construction is a stated objective of the present invention.

BRIEF SUMMARY OF THE INVENTION

Briefly stated, the golf putter construction that forms the basis of the present invention comprises a conventional putter head construction having a ball impact surface or face, which is provided with a plurality of cylindrical apertures disposed at spaced locations on the impact face.

As will be explained in greater detail further on in the specification, each of the apertures is dimensioned to receive a generally cylindrical weighted insert member. The selective placement of the weighted insert members into the putter impact face will bias the putter face into a "closed face" or an "open face" alignment to compensate for the individual golfers tendencies during their normal putting stroke.

In addition, this invention also contemplates the provision of a transparent cover plate for the face of the putter which will not only retain the insert members within the putter head while also providing a uniform impact surface, but which will also allow the user to visually confirm the exact placement and disposition of the weighted insert members relative to the putter head body.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
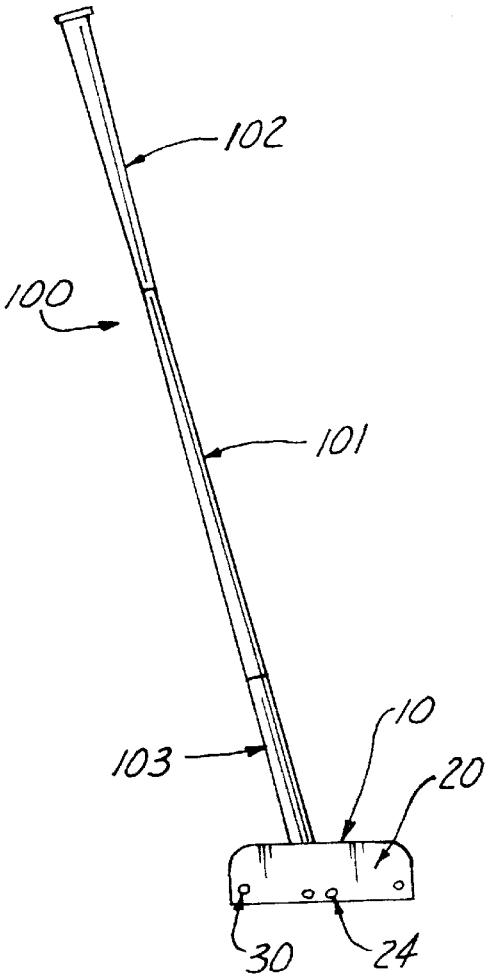
FIG. 1 is a front plan view of the putter construction that forms the basis of the present invention.
Figure 2:
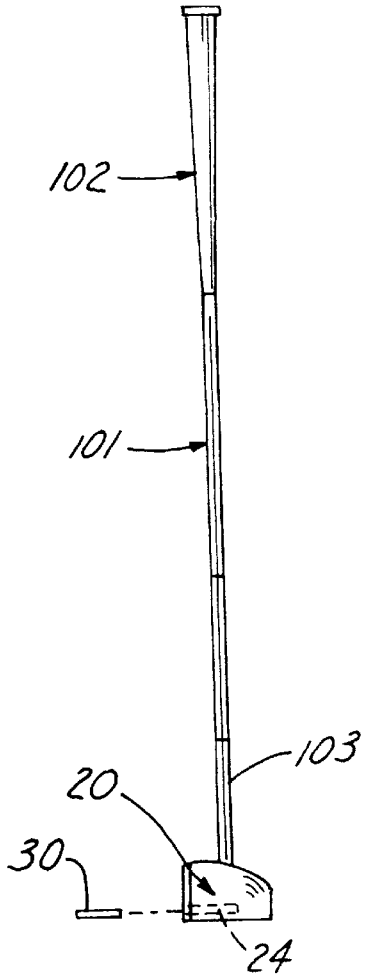
FIG. 2 is a side plan view of the golf putter construction.

As can be seen by reference to the drawings, and in particularly to FIG. 1, the golf putter construction that forms the basis of the present invention is designated generally by the reference number 10. The golf putter construction 10 is incorporated into a conventional golf putter designated generally as 100 and including a putter shaft 101 having a handle 102 provided on one end and a hosel 103 provided on the other end. The hosel 103 is operatively secured in a conventional manner to a golf putter head member designated generally as 20.

Figure 3:
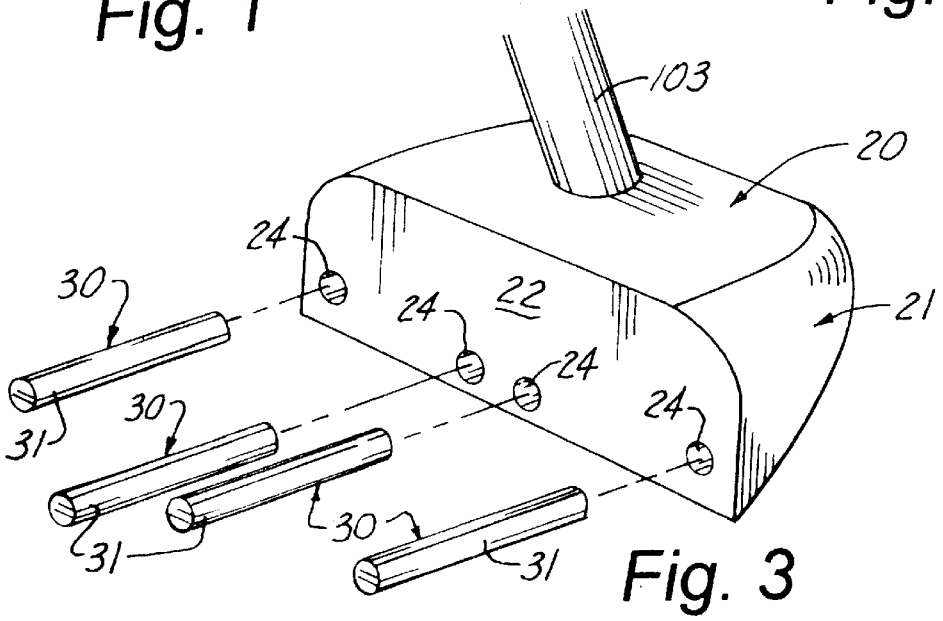
FIG. 3 is an exploded perspective view of the preferred embodiment of the putter construction.

As can best be seen by reference to FIG. 3 in the preferred embodiment of the invention, the putter head member 20 comprises a putter head body 21 provided with a generally vertical impact face 22. The impact face 22 is provided with a plurality of generally elongated cylindrical apertures 24 whose purpose and function will be described presently.

Still referring to FIG. 3, it can be seen that the putter construction 10 further includes a plurality of insert members 30 which comprise generally elongated cylindrical weighted elements 31 which are dimensioned to be received in the plurality of cylindrical apertures 24 formed in the impact face 22 of the putter head member 20.

In addition, as shown in FIG. 3, the plurality of apertures 24 are spaced from one another and generally horizontally aligned along the lower portion of the impact face 22.

Figure 4:
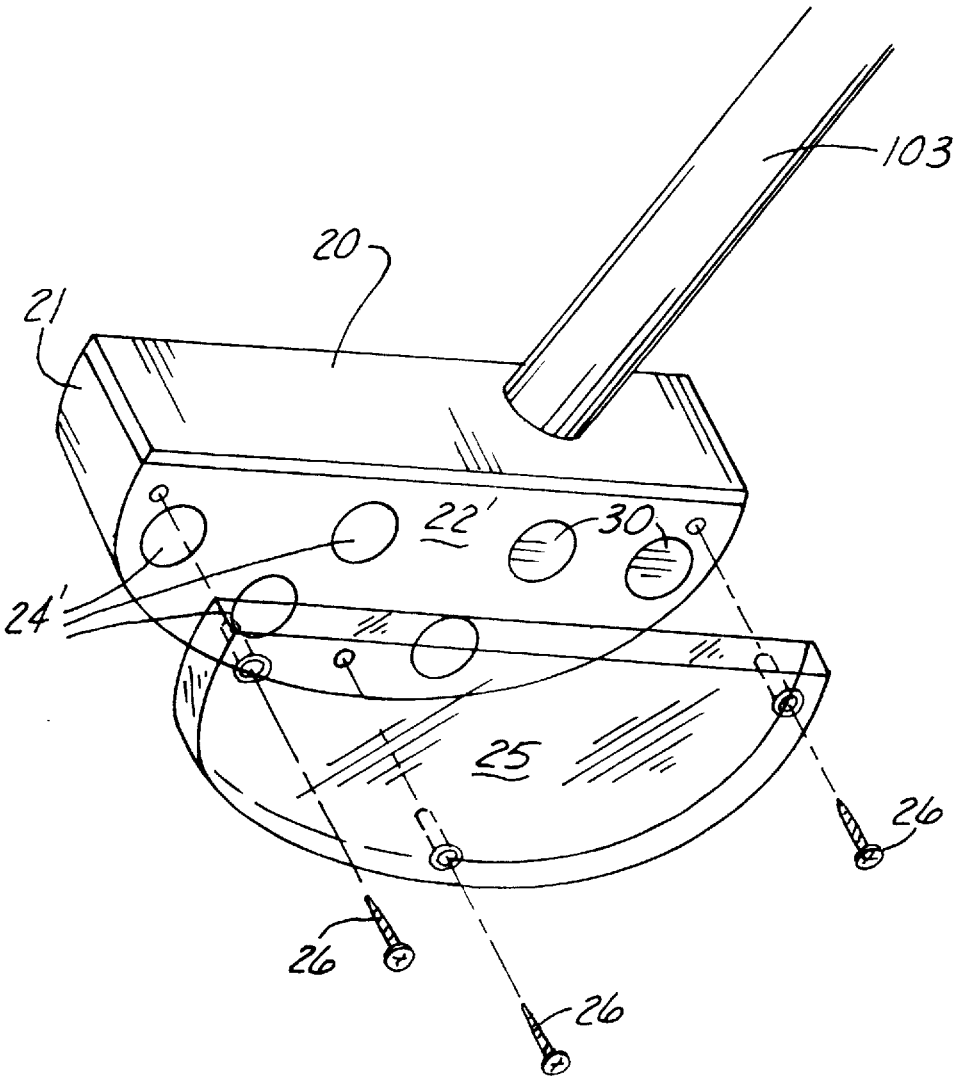
FIG. 4 is an exploded perspective view of an alternate version of the preferred embodiment.

In the alternate version of the preferred embodiment depicted in FIG. 4, the plurality of apertures 24' are disposed at various locations and heights on the face 22' of the putter head member 20. Furthermore, in this version of the invention, a transparent impact cover plate 25 is fixedly secured to the face 22' of the putter head member 20 by a plurality of conventional fasteners 26 for reasons that will be explained presently.

In the preferred embodiment of FIG. 3, the weight receiving apertures 24 are disposed in a generally horizontal alignment beneath the centerline of the putter head member 20. This placement serves several purposes in that it makes the putter head member "bottom heavy" thereby resisting a certain type of golfers tendency to lift the putter upwards during the putting stroke. Furthermore, the lower placement of the weights substantially precludes the possibility of golf ball coming into direct contact with either the weighted insert element 31 or the periphery of the surrounding apertures 24.

In addition, the lower placement of the weight increases the torque arm on the putter head member 20 to compensate for the golfers tendencies during the putting stroke. In those instances wherein the golfer has a tendency to open the face of the putter, the weighted insert element 31 would be inserted into the heel area of the putter. Whereas, in those instances wherein the golfer has a tendency to close the face of the putter, the weighted insert elements 31 would be inserted into the toe area of the putter.

In the alternate version of the preferred embodiment, the widely spaced locations of the different height apertures 24' increase the likelihood that golf ball (not shown) will come into contact with one or more of the weighted insert elements 31 or the apertures 24' thereby adversely influencing the direction of the struck golf ball. Therefore, even though the number and placement of both the apertures 24' and the plurality of insert members 30 provides a more refined system of weighting the putter head member 20, it is also necessary to add the clear impact cover plate 25 to provide a generally smooth impact surface for the golf ball.

In addition, the clear impact plate 25 also serves as a retention element to keep the weighted impact elements 31 within the selected apertures 24', but also allows the golfer to still visually verify the arrangement of the weighted inert elements 31 within the selected apertures 24' in the face 22 of the putter head member 20.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

I claim:

1. A golf putter construction for a putter head member having a putter head body provided with a generally vertical putter face having an upper portion and a lower portion wherein the putter construction consists of:

a plurality of cylindrical apertures formed in the generally vertical putter face and extending into the putter head body wherein said plurality of apertures are generally horizontally aligned along the lower portion of the vertical putter face;

a plurality of insert members dimensioned to be selectively received in said plurality of cylindrical apertures wherein each of said insert members comprise a generally cylindrical weighted element; and an impact cover plate which is fixedly secured to the vertical putter face to captively secure selected insert members within selected apertures in the vertical putter face wherein said impact cover plate is transparent; whereby the user can visually determine the location of the selected insert members within the selected apertures in the vertical putter face without the necessity of removing the impact cover plate.

* * * * *